US005704192A

United States Patent [19]

Jostler et al.

[11] Patent Number: 5,704,192

[45] Date of Patent: Jan. 6, 1998

[54] GUIDE MECHANISM FOR OPENING POCKETS OF A CONTINUOUS WEB

[75] Inventors: Jan Jostler; Ingemar Broden, both of Halmstad, Sweden

[73] Assignee: Joker System Aktiebolag, Halmstad, Sweden

[21] Appl. No.: 553,517

[22] PCT Filed: May 5, 1994

[86] PCT No.: PCT/SE94/00419

§ 371 Date: Nov. 3, 1995

§ 102(e) Date: Nov. 3, 1995

[87] PCT Pub. No.: WO94/27121

PCT Pub. Date: Nov. 24, 1994

[30] Foreign Application Priority Data

May 5, 1993 [SE] Sweden ..... 9301547

[51] Int. Cl.[6] ..... B65B 43/26; B65B 43/28; B65B 43/30; B65B 67/04

[52] U.S. Cl. ..... 53/384.1; 53/570; 53/389.1; 141/114; 141/166

[58] Field of Search ..... 53/455, 459, 469, 53/284.7, 562, 570, 385.1, 389.1, 384.1; 141/10, 114, 166, 313

[56] References Cited

U.S. PATENT DOCUMENTS

| | | | |
|---|---|---|---|
| 4,169,345 | 10/1979 | Douwenga | 53/570 |
| 4,514,962 | 5/1985 | Ausnit | 53/570 X |
| 4,558,556 | 12/1985 | Jostler | 53/459 |
| 4,665,552 | 5/1987 | Lems et al. | 53/570 X |
| 4,798,041 | 1/1989 | Bentsen | 53/570 X |
| 4,850,178 | 7/1989 | Ausnit | 53/570 |

FOREIGN PATENT DOCUMENTS

| | | |
|---|---|---|
| 54564 | 9/1985 | European Pat. Off. . |
| 433199 | 5/1984 | Sweden . |

*Primary Examiner*—Horace M. Culver
*Attorney, Agent, or Firm*—Ladas & Parry

[57] ABSTRACT

A guide mechanism (3) for positioning a continuously flexible packaging web (20) which has two opposite walls (21*a, b*) defining packaging blanks (26) disposed, in succession, in the longitudinal direction of the web. The packaging blanks have closed bottoms at the lower edge and opposing edge portions (24*a, b*) at the upper edge (23). The guide mechanism includes mechanical guide members (33*a, b*) provided with at least one channel (31*a, b*) for guiding the edge portions (24*a, b*) during displacement of the web in an apparatus for the supply of material into the packaging blanks (26). The mechanical guide members (33*a, b*) are formed from a number of links (30). In the region of the apparatus where the edge portions (24*a, b*) of the web are to be spaced transversely apart, the links are disposed in mutual spaced-apart relationship. In order to permit adjacent links to pivot and achieve the transversely spaced relation, shafts (37) are disposed between the faces of adjacent links and the links are urged against the shafts by springs (36).

10 Claims, 8 Drawing Sheets

GUIDE MECHANISM FOR OPENING POCKETS OF A CONTINUOUS WEB

FIELD OF THE INVENTION

The present invention relates to a guide mechanism for positioning a continuously flexible packaging web.

BACKGROUND AND PRIOR ART

There is need in the art for a mechanical guide mechanism opening the upper edges of the mouths of successively advancing packages of a, continuous flexible packaging web and thereby make them accessible for the supply of material therein.

EP-B1-0 054 564 discloses a guide mechanism of the above type. The guide mechanism includes guide members designed as rods along which a flexible packaging web is displaced. The guide rods are of a predetermined shape which is adapted to the size of the packaging blanks. When the dimensions of the openings of the packaging blanks are changed, the rods included in the guide mechanism are replaced by rods adapted to the new dimensions. The need for this exchange of rods reduces the flexibility of the guide mechanism.

SUMMARY OF THE INVENTION

The present invention provides a guide mechanism which, on changed dimensions of the openings of the packaging blanks, can be switched so as to adapt the distance between retainer devices for the edge portions of the packaging web to suit the size of the openings of the packaging blanks.

BRIEF DESCRIPTION OF THE FIGURES OF THE DRAWING

The present invention will now be described in greater detail hereinbelow, with reference to a number of Figures of the drawing, in which.

DETAILED DESCRIPTION OF PREFERRED EMBODIMENTS

Figure 1:
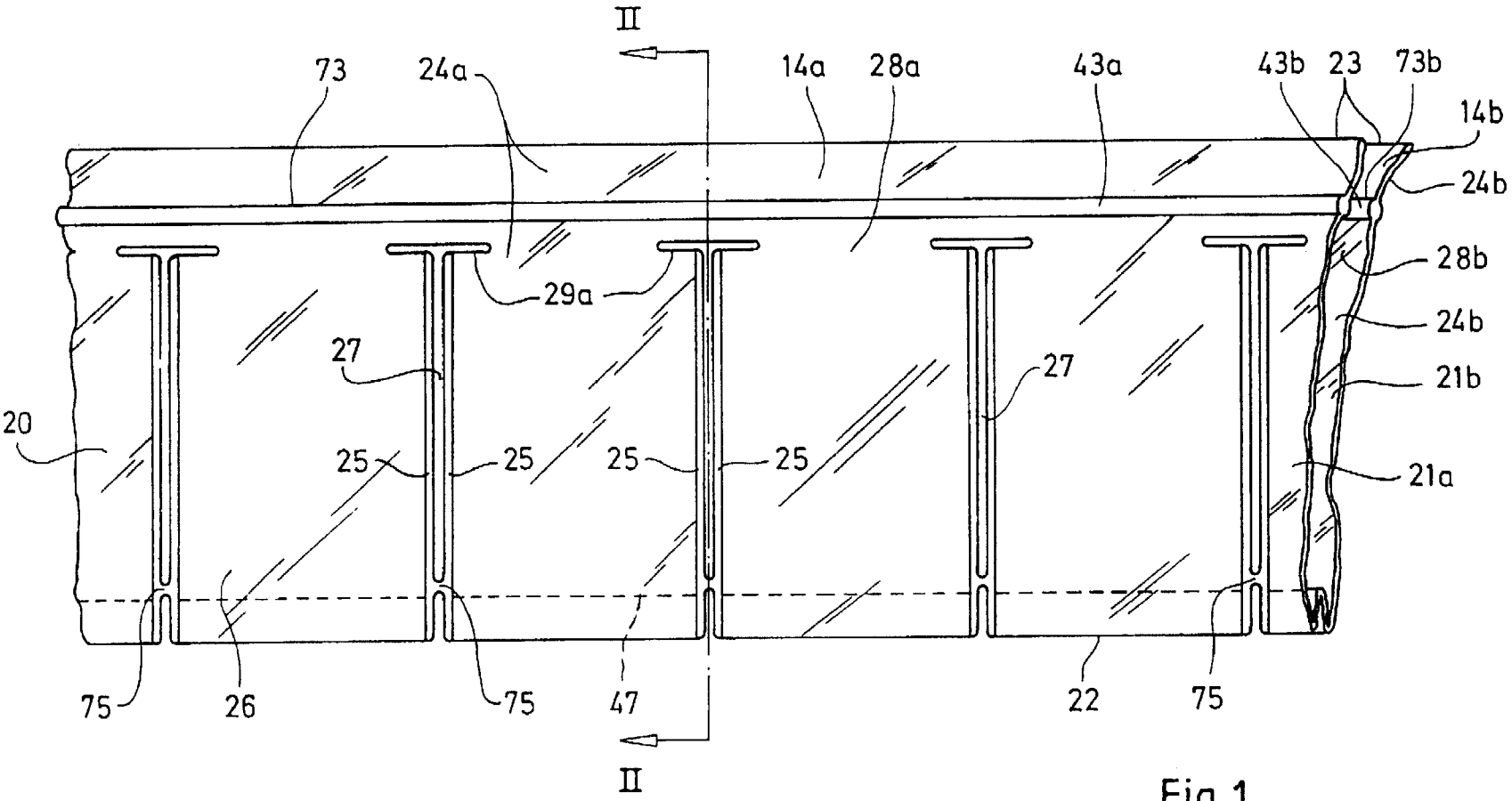
FIG. 1 is a perspective view of a portion of a packaging web.
Figure 2:
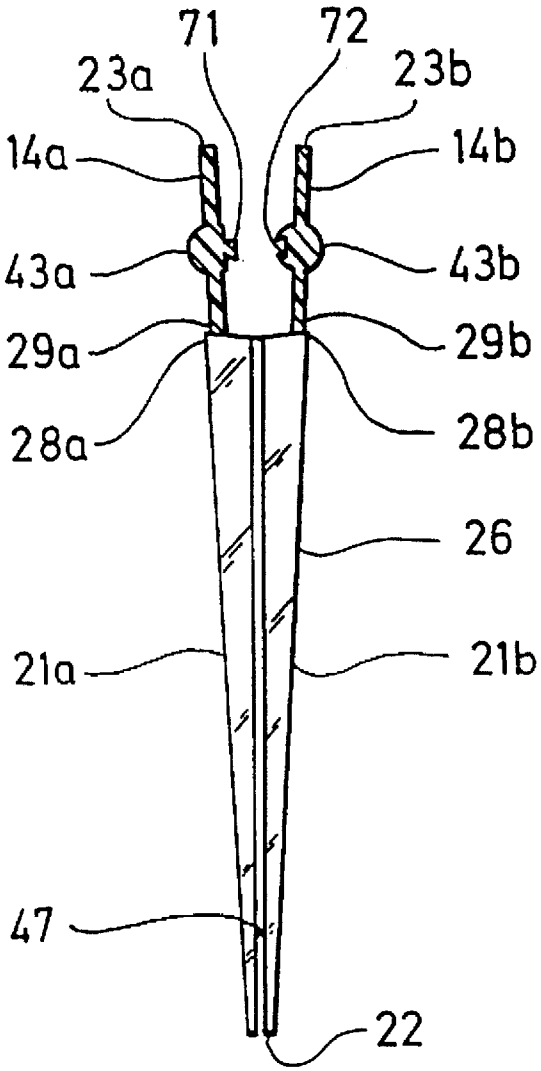
FIG. 2 is a cross-section taken on line II—II in FIG. 1.

FIGS. 1 and 2 show one embodiment of a continuous packaging web or belt 20 of flexible material which has two opposing walls 21*a,b* and longitudinal first and second edges 22 and 23, respectively. The web includes a number of mutually subsequently disposed packaging blanks or pockets 26. The pockets each have a bottom portion at said first edge 22, and two connection zones or joints 25, occasionally designated transverse zones 25, which are transversally directed in relation to the longitudinal direction of the web and which form the side closures 25 of the pockets. In FIGS. 1 and 2, the web is shown with a folded-in bottom. The upstanding definition of the folded-in bottom has reference numeral 47 and corresponds to a center line of a sheet which has been folded together on the formation of the packaging web. Between the joints of two adjacent pockets or bags there is a transverse slot 27 which defines the pockets from one another. In certain embodiments, mutually adjacent pockets 26 are united by means of one or more bridges 75. In this instance, such bridges are as a rule disposed in the vicinity of the first edge 22 of the belt.

Each respective wall 21*a,b* includes two opposing edge portions 24*a,b* which extend in the longitudinal direction of the web at its said second edge 23, each one including a continuously retained member generally designed as a material thickening, 43*a,b* for cooperation with mechanical members 33*a,b* (cf. FIG. 3) for guiding the edge portions 24*a,b* on displacement of the web 20 into an apparatus 3 for feeding material into the pockets 26.

In the illustrated embodiment, a longitudinal slot 29 is provided on either side of each transverse slot 27. The longitudinal slot is located between the retainer members 43*a,b* and the pockets 26. Two mutually adjacent longitudinal slots are thus located in spaced apart relationship from one another in the longitudinal direction of the web.

Each one of the edge portions 24*a,b* includes a strap-like portion 14*a,b* which forms the other edge 23 of the web. The strap-like portion 14*a,b* merges into the retainer members 43*a,b* in the direction towards the pockets 26. The connections of the straps to the retainer members 43*a,b* carry reference numerals 73*a,b*.

Figure 3A:
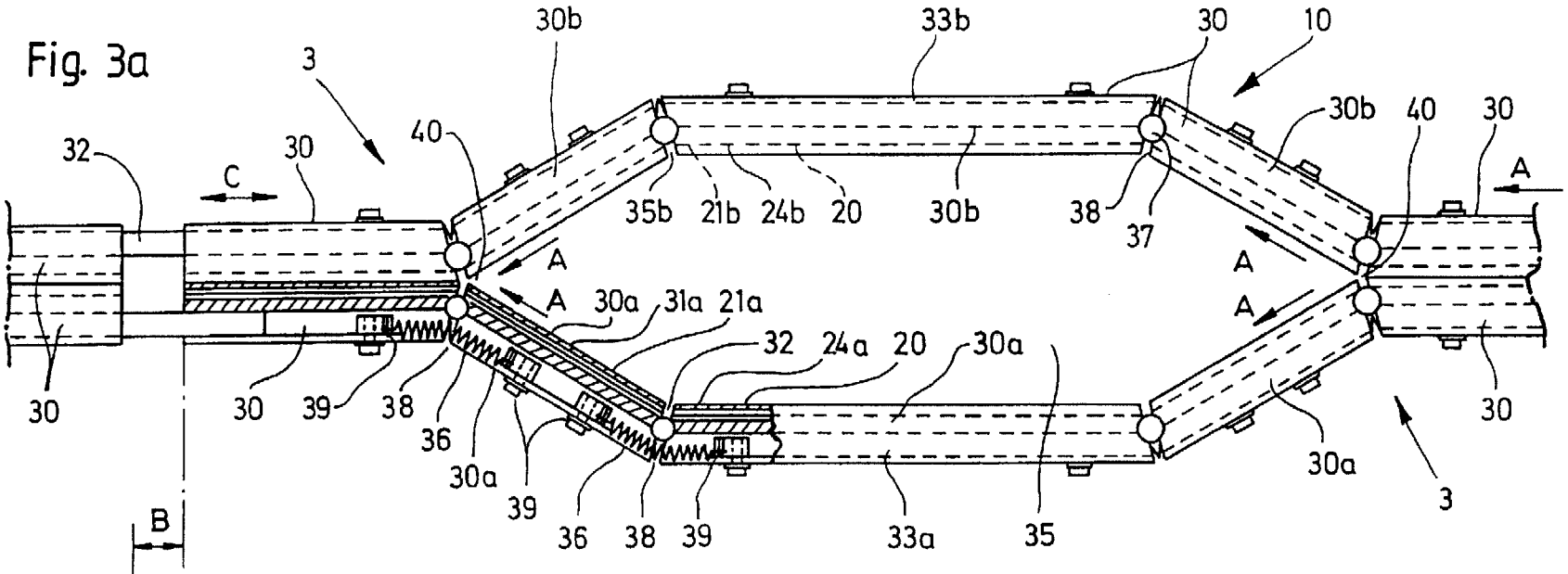
FIG. 3*a,b* show portions of a first embodiment of the guide mechanism in the region of the opening of packaging blanks, where the guide mechanism is composed of links.
Figure 3B:
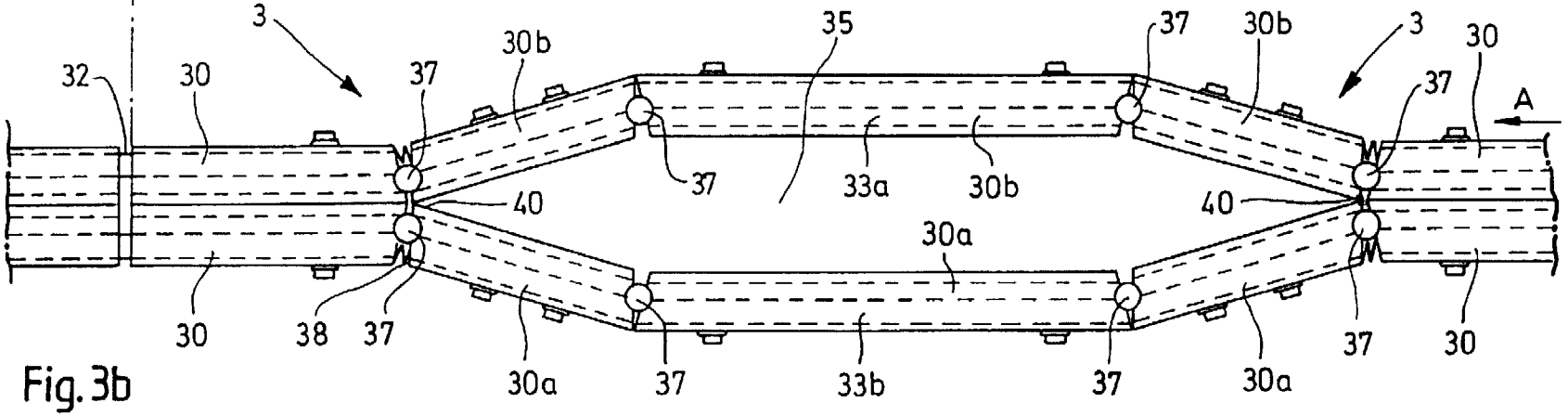
Figure 4B:
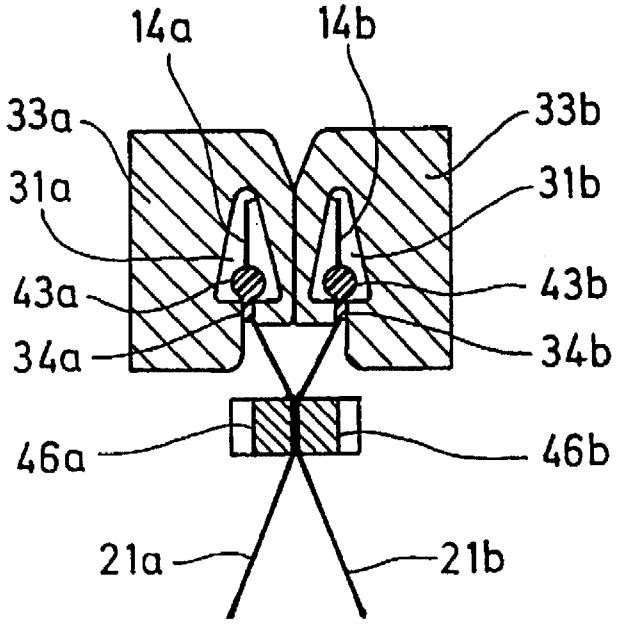
FIG. 4*a,b* are cross-sections of mechanical guide members for guiding the packaging web where FIG. 4*b* also shows the upper portion of the packaging web.
Figure 4A:
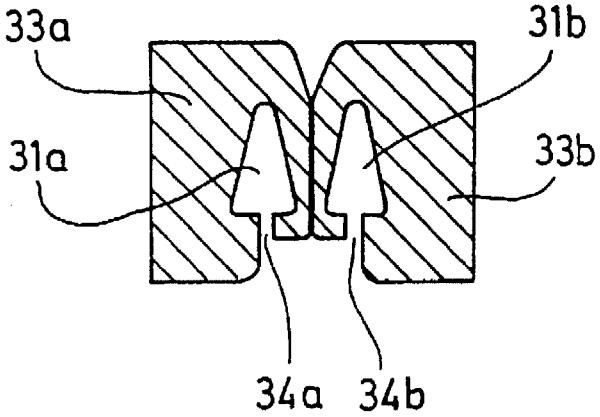

In FIGS. 3*a* and 3*b*, as well as FIGS. 4*a* and 4*b*, there is shown one embodiment of a guide mechanism 3 comprising a number of mutually successively disposed guide members or links 30. A transition 32 is formed between two mutually subsequent adjacent links, in which transition there is disposed a mechanical shaft 37 arranged at right angles to the longitudinal axes of the links. The shaft 37 is located between the end surfaces 38 of the links. These end surfaces are in turn located a short distance from one another so that the links are, to a limited extent, rotatable in relation to one another about the mechanical shafts 37. The end surfaces are as a rule disposed at an oblique angle to the longitudinal direction of the links and are generally substantially planar. In practical applications where particularly large changes in direction are required in the transitions 32, they are given a slightly rounded shape. At the same time, the links are made relatively short. The links include a channel 31*a,b* in which the thickened portions 43*a,b* of the packaging web 20 are displaced in the direction of the arrows A.

In the right and left-hand portions of the Figures, the links are in two lines in lateral abutment against one another while, in the central portions of the Figures, the links 30 in the two lines are transversely spaced apart so that a gap exists between them. The transitions between those parts of the guide mechanism where the line of links are located adjacent to one another and that part of the path where the links are separated carries reference numeral 40.

FIG. 4*a* is a cross-section through one embodiment of the links 30*a,b* where the links have through gaps 34*a,b* downwardly directed in the Figure. The width of the gaps is selected so that the thickened portions 43*a,b* of the packaging web cannot pass through the gaps. In FIG. 4*b*, driving belts 46*a,b* are also shown, these generally being designed as cogged belts. The driving belts press both walls 21*a,b* of the packaging belt between them and thereby the walls against one another in the edge regions 24*a,b* of the packaging web and thereby displace, on their movement, the packaging web in the longitudinal direction of the channels 31*a,b*.

In a broken away portion of FIG. 3*a*, there are shown, in addition to the channel 31*a* and the wall 21*a* of the packaging web, longitudinal elastic means, e.g. springs 36 which are, in the extended state and are secured to retainer devices 39. The springs are disposed so that they traverse the transition 32 between two mutually subsequently disposed links 30. Each spring is thus secured at retainer devices 39 disposed in two different links. The channels 31*a,b* in the links 30*a,b* are open in the surfaces 38 of the links on opposite sides of the mechanical shafts 37 and substantially in register with the openings of the channels 31*a,b* of the following links. Hereby, the channels of the links 30 form a substantially continuous guide for positioning the thickened portions 43*a,b* of the packaging belt 20.

In FIG. 3*a*, the distance between the mutually separated links is greater than in FIG. 3*b*. The difference in distance is determined by the distance between the transitions 40 where the links 30*a,b* are diverge from one another and where the links 30*a,b* once again connect to links 30 in abutment against one another, respectively. In order to regulate this distance, the size of the opening 35*a,b* between mutually subsequently located and laterally mutually abutting links is lockably adjustable for one or more transitions 32 adjacent the separated links. This is clearly shown in FIGS. 3*a,b* by the arrow B. In FIG. 3*a*, the distance between the transitions 40 is less than in FIG. 3*b*.

The springs 36 act to turn adjacent links so that their opposing end surfaces 38 contact one another, but this turning movement is prevented by the fact that the positions of the transitions 40 are fixed. The described construction of the guide mechanism entails that the opening 35 which is formed between the separated links is determined and continuously adjustable for adaptation to the size of the packaging blanks which are included in the packaging web. Locking of the adjusted size of the opening 35 is obtained by fixing the mutually adjacent links 30 in relation to one another and thereby the distance B determining the size of the opening 35. It is obvious that a corresponding function is achieved if the springs 36 and the channels 31 change place in relation to the mechanical shaft 37.

Figure 5A:
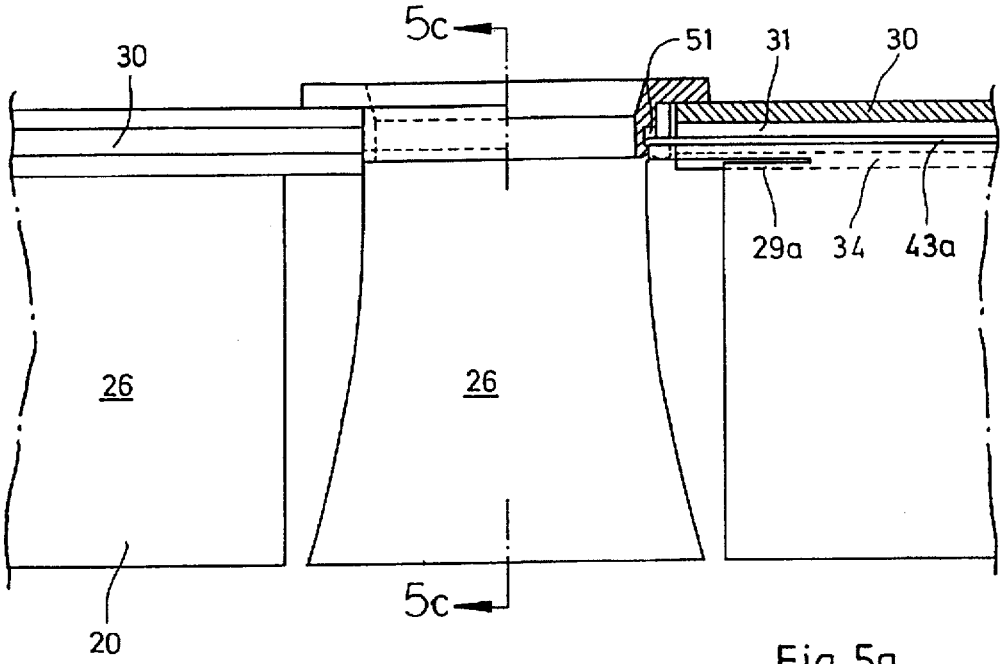
FIG. 5*a* is a sectional view of a second embodiment of the guide mechanism taken along line 5*a*—5*a* in FIG. 5*b*, where the guide mechanism is provided with a mechanically stable guide member for opening a packaging blank.
Figure 5B:
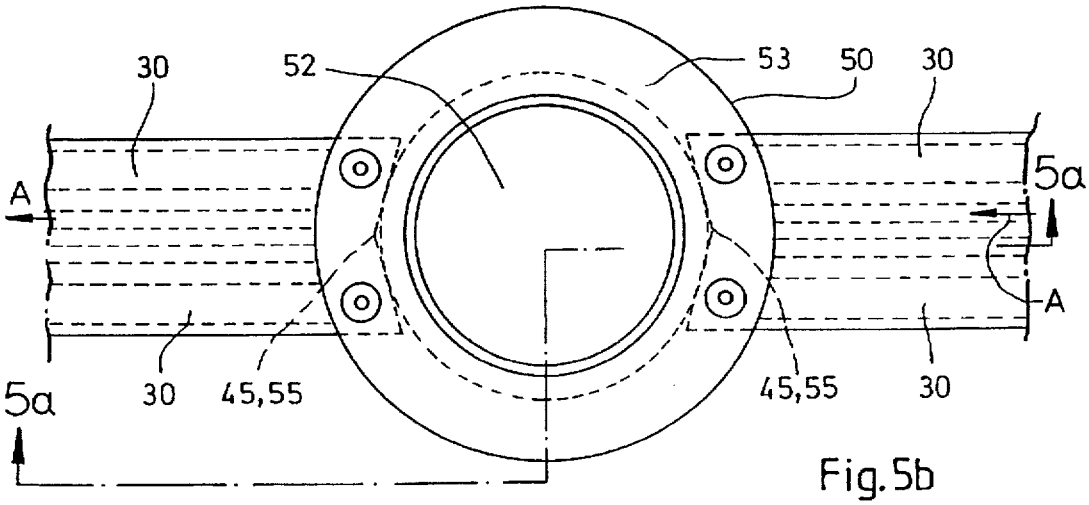
FIG. 5*b* shows the guide mechanism of FIG. 5*a* seen from above.
Figure 6B:
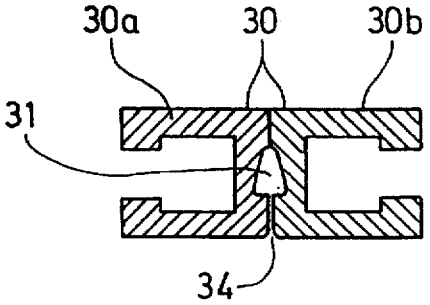
FIG. 6*b* is a sectional view taken along line 6*b*—6*b* in FIG. 6*a;*
Figure 6A:
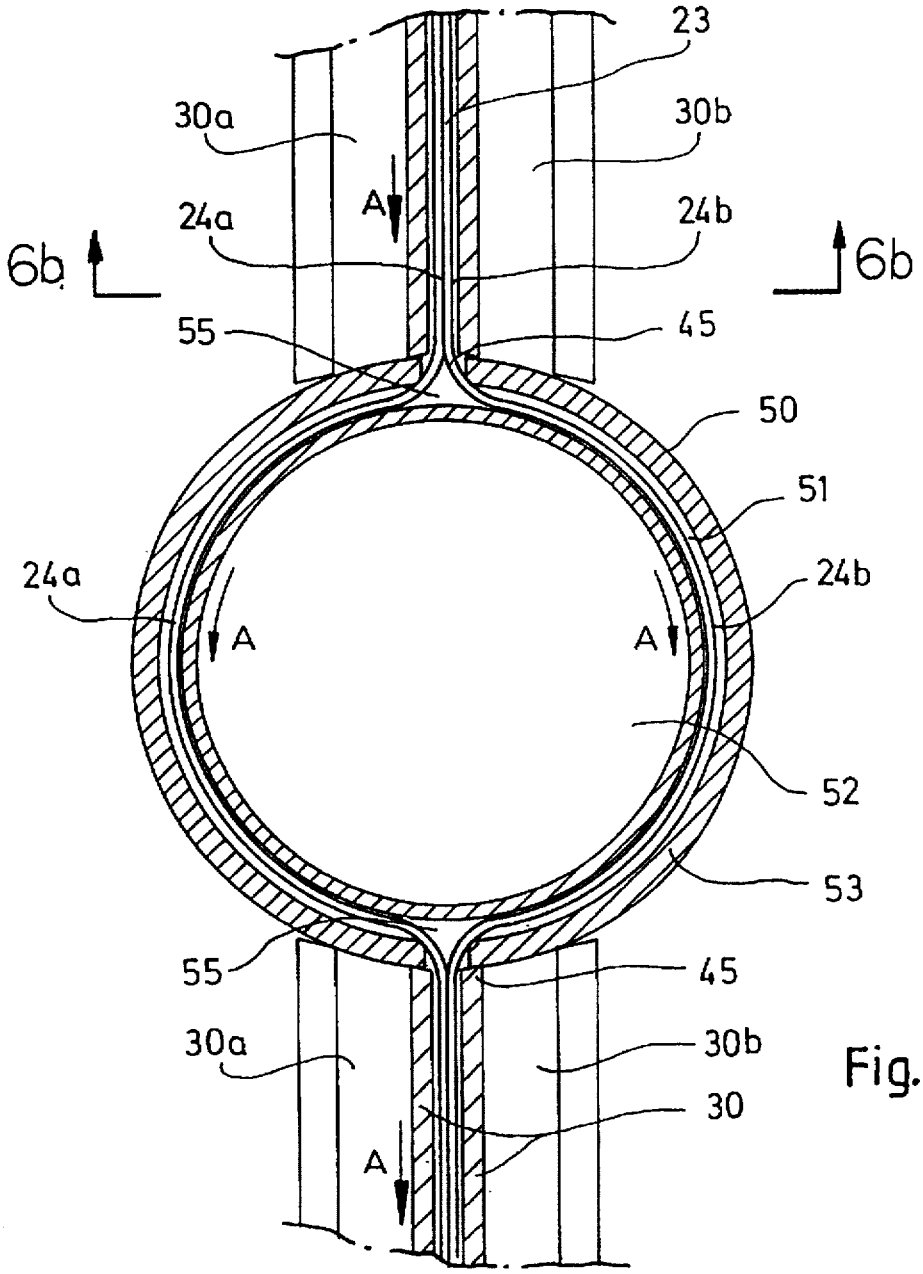
FIG. 6*a* shows a third embodiment of the guide mechanism from above and provided with a mechanically stable guide member and with an alternative version of the links in the guide mechanism.

FIGS. 5*a* and 5*b* as well as FIGS. 6*a* and 6*b* show another embodiment of the guide mechanism where an opening 52 corresponding to the previously described opening 35 between separated links is formed by a mechanically stable device 50. This device has an edge portion 53 disposed in the circumferential direction of the opening 52 and accommodating channels 51*a,b* which open in regions 55 in association with the regions 45 at which channels 31*a,b* of adjoining links open or alternatively a common channel 31 for the links. In the embodiment shown in the Figures, the edge portion 53 is composed of an inner portion 53*a* and an outer portion 53*b* between which the channels 51*a,b* are disposed. Also in this embodiment, the channels are accessible through a gap 54 which is formed between both parts. The width of the gap is less than the thickness of the thickened portions 43*a,b* of the packaging belts.

All of the above described embodiments of the guide mechanism 3 are intended for handling and filling a packaging web 20 with the slots 29*a,b* disposed in the longitudinal direction of the web and described with reference to FIGS. 1 and 2. Occasionally, packaging webs are, however, required which do not have these slots. One embodiment of the present invention will be described hereinbelow with reference to FIGS. 7*a* and 7*b* in which the guide mechanism 3 is disposed to be displaced and make possible filling of packaging blanks included in the packaging web but in which the packaging web has no longitudinal slots for facilitating opening of the packaging blanks.

Figure 7B:
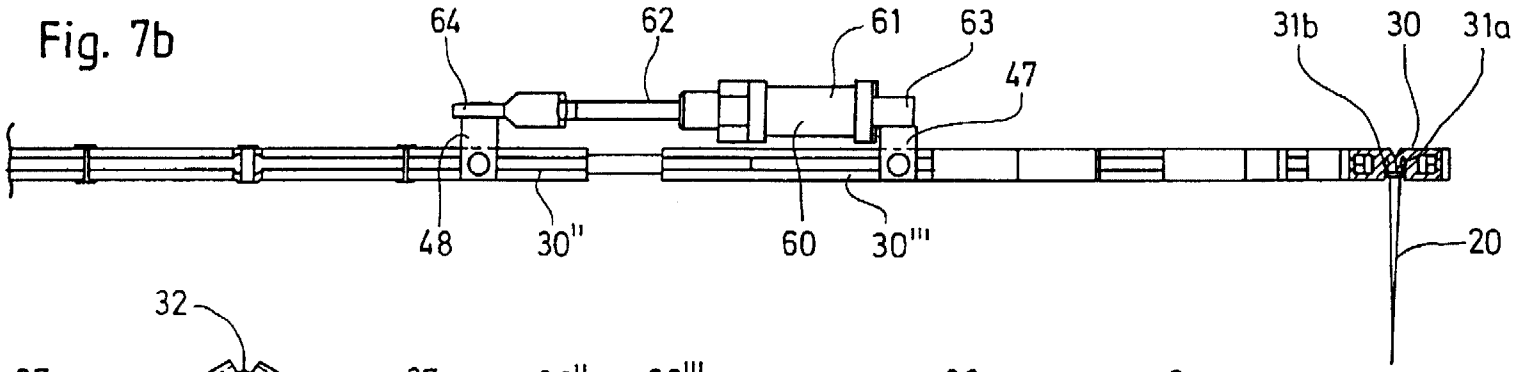
FIG. 7*b* is a side view of the guide mechanism in FIG. 7*a*.
Figure 7A:
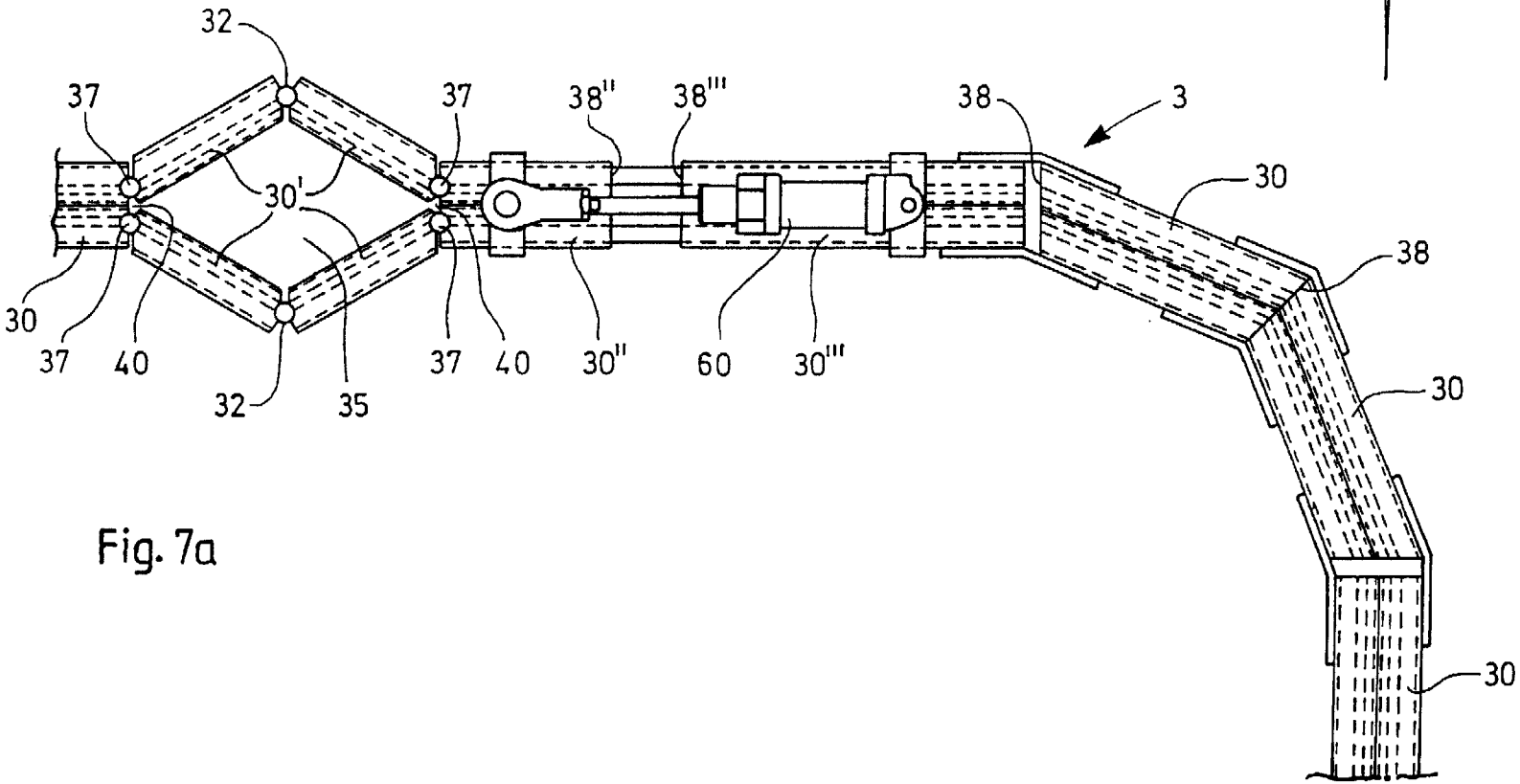
FIG. 7*a* shows a fourth embodiment of the guide mechanism seen from above.

FIGS. 7*a* and 7*b* show a guide mechanism 3 where the opening 35 between separated links is formed by four part links 30' which are displaceable between positions in which the links 30' are parallel with one another and abut against one another, and positions in which the links pairwise make an angle with one another. The links are journalled at the mechanical shafts 37 for connection to successive links 30 corresponding to that described above. In the direction of transport of the web, two links 30", 30'" which precede or follow the links which make the opening are displaceably disposed in relation to one another. The distance between the end surfaces 38", 38'" of the links is variable from no distance to a distance corresponding to that distance which entails maximum angle between the pairwise disposed links 30'. For displacement of the mutually shiftable links 30", 30'" there is provided a drive member 60, as a rule a hydraulic unit, comprising a cylinder 61 and a piston (ram) 62. The drive member is provided with anchorage means 63, 64 which are interconnected with fixing members 47, 48 provided on the links 30", 30'". The links or the drive member are lockable in the set position.

FIG. 7*a* also shows how links with obliquely inclined end surfaces 38 are connected to one another so as to form a curved conveyor path.

When using the guide mechanism 3 illustrated in FIGS. 3–4, the packaging web 20 is continually or intermittently drawn in the direction of the arrows A by means of the driving belts 46*a,b*. Both opposing edge portions 24*a,b* of the packaging belt 20 are positioned by the channels 31*a,b* and the gaps 34*a,b* of the mechanical guide members 33*a,b*. The gaps prevent the material thickened portions 43*a,b* of the web from leaving the channels when the thickened portions of the web are displaced in the longitudinal direction of the channels. When the web passes a transition 40 for the first time, the mechanical guide members 33*a,b* displace the edge portions 24*a,b* of the web away from one another, and when the web reaches the next transition 40, the mechanical guide members return the edge portions 24*a,b* of the webs to positions adjacent one another.

The packaging blank or blanks which are located in the region between the two transitions 40 are thereby held open by the mechanical guide members and are accessible for the supply of material. The mechanical guide members 33*a,b* set the maximum distance between the edge portions 24*a,b* at a size which is dependent upon the adjustments of the conveyor path which had been carried out previously in view of the length of the slots 29 of the packaging belt.

The distance between the mechanical guide members 33*a,b* which are located between said transitions 40 is adjusted by means of the link 30 by displacement thereof in the direction of the double arrow C (cf. FIG. 3*a*). On the displacement of the link 30, the distance B between the link 30 and an adjacent link 30 is altered. In such instance, the distance between the web transitions 40 in which the mechanical guide members 33*a,b* displace the edge portions of the web away from or towards one another is also altered.

In FIG. 3*b*, the distance is slight in the transition 32 between the two adjacent links 30, and the distance is large between the transitions 40 in which the mechanical guide members 33*a,b* displace the edge portions of the belt away from or towards one another. The distance between the mechanical guide members 33*a,b* in the region between the previously mentioned transitions 40 is thereby slight.

On switching of the distance, the links are rotated about the mechanical shafts 37 in the transitions 32 between the links for those links which are located at the transition 40 or in the region between the transitions 40. The springs 36 act to move the end surfaces 38 of the links into abutment against one another in those areas of the end surfaces which are located on the same side of the mechanical shafts 37 as the springs 36. The rotational position to which the links are set is determined by the positions of the links 30 to which the mechanical guide members 33*a,b* merge into the transitions 40.

Figure 5C:
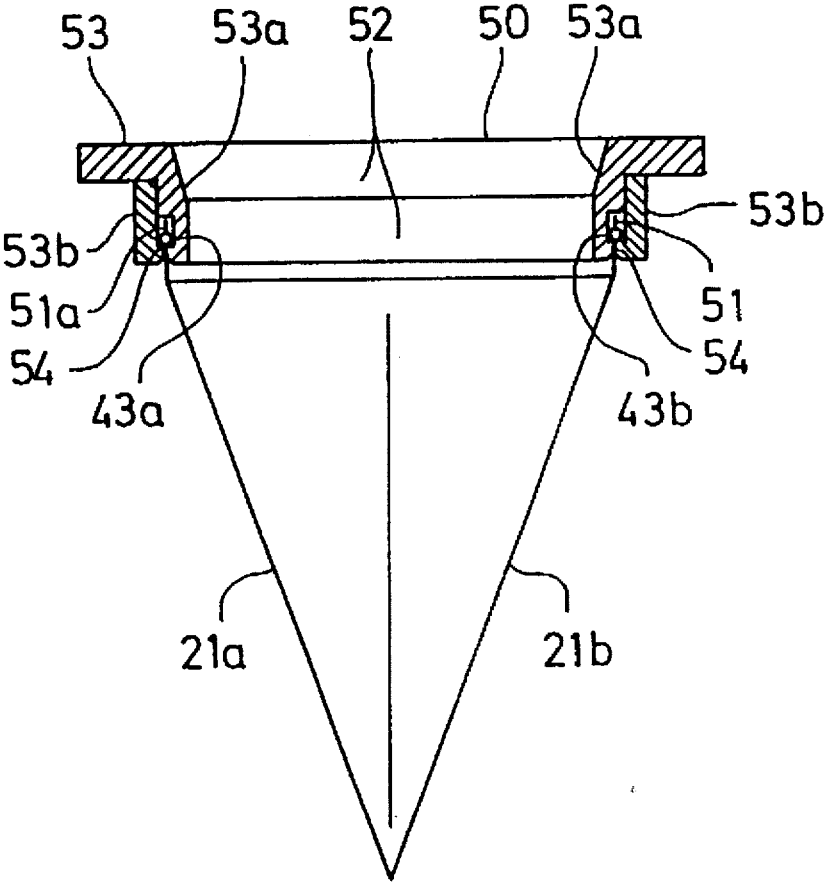
FIG. 5*c* is a sectional view taken along line 5*c*—5*c* in FIG. 5*a;*

When the embodiments illustrated in FIGS. 5 and 6 are put into use, the packaging web 20 is displaced by drive means (not shown in the drawings) in the direction of the arrows A. The opposing edge portions 24*a,b* of the packaging web are displaced in the longitudinal direction of the channels corresponding to that described in connection with FIGS. 3 and 4, at the same time as a packaging blank 26 which is positioned in the channels 51*a,b* of the mechanically stable guide member 50 is kept open for the supply of material through the opening 52 of the mechanically stable guide member 50. Since the mechanically stable guide member 50 has a determined shape, no devices are necessary here for altering the distance between the links 30 and the mechanically stable guide member. As a rule, the embodiment of the links 30 illustrated in FIG. 6*b* is chosen, according to which the links are formed from two part links 30*a*, 30*b* which, therebetween, form the channel 31 and the through gap 34.

On employment of the guide mechanism illustrated in FIGS. 7*a* and 7*b*, which is particularly suitable for handling packaging belts 20 with packaging blanks 26 which lack the horizontal slot 29, the web 20 is moved through the channels 31 by means of displacement devices (not shown). In the starting position, the separable links 30' are located in positions adjacent one another. When a packaging blank 26, with the links 30 abutting against one another, assumes the position in which the central portions of the blank are located in the region of the transitions 32 between the links 30' which may be displaced pairwise between positions in which they abut against one another and pairwise make an angle with one another, the drive means 60 displace the links 30', 30" from one another whereby the distance between the transitions 40 is reduced and the links 30' are rotated outwardly from their positions adjacent one another. In this instance, the packaging blank 26 is opened and will be accessible for the supply of material. The length of the channel 31 of these two links which are located between the transitions 40 is the same irrespective of the position assumed by the links. Hereby, the need for slots to open the packaging blanks 26 will be eliminated.

It will also be apparent from FIG. 7*a* that the guide mechanism is given a curved configuration by providing one or more links with end surfaces 38 which make an acute angle with one another. In other practical applications of the invention, use is made, in straight sections of the guide mechanism, of links 30 which have mutually parallel end surfaces 38 which are located at an oblique angle to the longitudinal direction of the links. Cf. the angled links 30 shown in FIG. 3*a* most proximal to the transitions 40.

In the above description, use has occasionally been made of the designations upper, lower, right, left etc. These designations have been employed to facilitate presentation of the invention. It is obvious to a person skilled in the art that the described technique generally permits an optional spatial orientation of the path.

The above detailed description has referred to but a limited number of embodiments of the present invention, but a person skilled in the art will readily perceive that the present invention accommodates a large number of embodiments without departing from the spirit and scope of the appended claims.

What is claimed is:

1. A guide mechanism for guidably supporting thickened portions of upper ends of opposite walls of successive pockets of a flexible, longitudinal web to permit longitudinal advance of said web and opening of mouths of the pockets for supply of material thereinto, said guide mechanism comprising two lines of a plurality of guide members, the guide members in each line having respective channels for guidably receiving the thickened portion of a respective wall of the longitudinal web, said lines of guide members being transversely spaced apart to open the mouths of the pockets at a filling station at which material is introduced into said pockets, said lines of guide members undergoing transitions from an adjoining relation upstream and downstream of said filling station to said transversely spaced relation at said filling station, said guide members having adjoining faces at the transitions and in the transversely spaced lines, means provided at the adjoining faces of adjoining guide members at said transitions and therebetween for enabling said adjoining guide members to rotate relative to one another, and means for longitudinally displacing selected guide members in said two lines for varying the transversely spaced relation of said guide members at said filling station.

2. A guide mechanism as claimed in claim 1, wherein said means for enabling said adjoining guide members to rotate relative to one another comprises shafts located at adjoining faces of said adjoining guide members, said shafts extending at right angles to longitudinal axes of said guide members, said guide members rotatably engaging said shafts.

3. A guide mechanism as claimed in claim 2 comprising spring means secured to adjoining guide members at said filling station for urging said adjoining guide members against said shafts.

4. A guide mechanism as claimed in claim 2, wherein the channels in the guide members adjoining each shaft open at the faces of said guide members adjacent to said shaft.

5. A guide mechanism as claimed in claim 2, wherein the channels in the guide members adjoining each shaft open at the faces of said guide members adjacent to said shaft, said spring means also extending adjacent to said shaft.

6. A guide mechanism as claimed in claim 1, wherein each guide member has a gap through which the associated wall of the web can pass but through which the thickened portion cannot pass.

7. A guide mechanism as claimed in claim 1, wherein the faces of adjacent said guide members between said transitions are obliquely inclined relative to longitudinal axes of said guide members.

8. A guide mechanism as claimed in claim 7, wherein the longitudinal axes of adjacent guide members between said transitions form an angle therebetween, said faces of said adjacent guide members being parallel to one another.

9. A guide mechanism as claimed in claim 1, wherein said guide members in each line between said transitions are two in number.

10. A guide mechanism as claimed in claim 1, wherein said guide members in each line between said transitions are three in number and include a center guide member extending parallel to a longitudinal axis of the guide mechanism along which the web is advanced, and transversely spaced from said axis and two end guide members obliquely inclined from said center guide member towards said longitudinal axis.

* * * * *